United States Patent [19]

Chen et al.

[11] 4,247,384

[45] Jan. 27, 1981

[54] LIQUEFACTION OF CARBONACEOUS MATERIALS

[75] Inventors: Nai Y. Chen, Titusville, N.J.; Dennis E. Walsh, Richboro; Tsoung Y. Yan, Philadelphia, both of Pa.; Darrell D. Whitehurst, Titusville, N.J.

[73] Assignee: Mobil Oil Corporation, Fairfax, Va.

[21] Appl. No.: 20,601

[22] Filed: Mar. 15, 1979

[51] Int. Cl.[3] ..... C10G 1/00

[52] U.S. Cl. ..... 208/8 LE; 208/10

[58] Field of Search ..... 208/8 LE, 8 R, 10

[56] References Cited

U.S. PATENT DOCUMENTS

| | | | |
|---|---|---|---|
| 3,642,607 | 2/1972 | Seitzer | 208/8 LE |
| 3,715,303 | 2/1973 | Wennerberg | 208/10 |
| 4,052,292 | 10/1977 | Espenscheid | 208/8 |

*Primary Examiner*—Brian E. Hearn

*Attorney, Agent, or Firm*—Charles A. Huggett; Charles J. Speciale

[57] ABSTRACT

Improved method for solubilizing solid carbonaceous materials, e.g., wood and/or coal in an aromatic petroleum or coal-derived solvent in the presence of alkali and hydrogen transfer agent at elevated temperatures. The liquid products can be used as fuels or further processed into desirable products.

7 Claims, No Drawings

LIQUEFACTION OF CARBONACEOUS MATERIALS

This invention relates to the conversion of solid carbonaceous materials, such as peat, wood, cellulose, plants, lignite and coal into liquid-form fuels.

BACKGROUND OF THE INVENTION

As is well known, solid carbonaeous materials, e.g., wood and coal can be liquefied by controlled heating in the absence of oxygen to obtain a liquid, gas and char. Such technology is of especially important consideration in view of the depletion of the world's petroleum reserves and represents a plausible route for utilization of such carbonaceous material resources to complement and enhance conventional petroleum fuels and chemical products derived from petroleum. Naturally, the conversion of such materials into liquid form, especially as a fuel, is extremely desirable because of the ease of handling in various petroleum-treatment processes, and more particularly to permit use along with conventional liquid petroleum products in current energy utilization technology which is adapted to handle liquid sources of energy.

Thus, due to the compelling factors of economy and conservation, the technology of coal liquefaction has been growing considerably. The production of oil by the destructive distillation of wood has also been receiving increased attention.

The conversion of cellulose and/or wood to a hydrocarbon-like product requires the removal of combined oxygen. Rejection of oxygen in the form of water would not lead to the formation of hydrocarbons unless external hydrogen is added. Rejection of oxygen by the formation of $CO_2$, on the other hand, could, in theory, enrich wood in hydrogen without the addition of any external hydrogen. Thus, the decarboxylation of wood represents a desirable process for the upgrading of wood from a carbohydrate rich solid to a petroleum-like liquid. The degree of upgrading may be measured by the effective hydrogen concentration of the product. This effective hydrogen index is defined in terms of atomic ratios as follows:

$$H/C_{(effective)} = \frac{(H) - 2(O) - 3(N) - 2(S)}{(C)}$$

where H, C, O, N, S are the number of atoms per formula weight of sample of hydrogen, carbon, oxygen, nitrogen and sulfur, respectively, as determined by elemental analysis.

Thus, for example, cellulose $(C_6H_{10}O_5)_n$, the main building block of wood, being a carbohydrate, has an effective hydrogen index of zero; the rejection of $O_2$ as water leads to carbon and not hydrocarbon.

U.S. Pat. No. 4,052,292 is representative of most recent technology and decribes the conversion of carbonaceous materials into liquid products by heating slurries of these materials in aromatic solvents at elevated temperatures. While the process described in the said patent is quite effective in converting said materials into liquid products, the product still contains a significant amount of combined oxygen and a relatively low effective hydrogen index.

Thus, there remains the need for improvement of the procedures for converting carbonaceous materials to liquefied products of higher effective hydrogen index and lower combined oxygen content.

The present invention provides an improved method for converting carbonaceous materials into liquid products having application as fuels and chemical derivatives. More specifically, the present invention provides a process to solubilize carbonaceous materials in an aromatic petroleum or coal-derived solvent to yield a product of improved effective hydrogen index, particularly in comparison with the product produced in accordance with U.S. Pat. No. 4,052,292. Thus, the present invention comprises an improvement in the process of the aforesaid U.S. patent. To this end, the entire disclosure of the said U.S. patent is incorporated herein by reference.

By "solid carbonaceous material" as employed in this disclosure and in the appended claims is meant wood, cellulose, plants, coal, peat, lignite, and similar naturally-occuring solid materials, including mixtures of these.

DESCRIPTION OF THE INVENTION

The instant invention is accomplished by slurrying the solid carbonaceous materials in a thermally stable aromatic petroleum or coal-derived solvent and heating the thus-formed slurry at elevated temperature in the presence of a hydrogen donor and alkali to evolve carbon oxides from the slurried materials.

By the term "thermally stable aromatic petroleum solvents" is meant a relatively high boiling petroleum conversion product of fluidized catalytic cracking obtained as (FCC) "main column" bottoms or a product of thermofor catalytic conversion (TCC) obtained as "syntower" bottoms. These materials contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, and their derivatives. Such highly refractory petroleum media or bottoms are highly resistant to conversion to lower molecular products by conventional non-hydrogenative procedures. Typically, these petroleum refinery bottoms and some lower boiling recycle fractions are hydrocarbonaceous mixtures having an average carbon to hydrogen atomic ratio in the range of about 0.6—1.3, and a boiling point above about 450° F. and ranging up to about 1100° F.

The petroleum solvents suitable for the practice of the present invention process are preferably thermally stable, highly polycyclic aromatic rich mixtures which result from one or more petroleum refining operations comprising catalytic cracking. Representative heavy or high boiling petroleum solvents include main column and syntower bottoms; asphaltic material; alkanedeasphalted tar; coker gas oil; heavy cycle oil; FCC main tower clarified slurry oil; mixtures thereof, and the like.

The nominal properties of suitable petroleum solvents are as follows:

| Syntower Bottoms | |
|---|---|
| Sulfur | 1.13% |
| Nitrogen | 450 ppm |
| Pour Point | 50° F. |
| Initial Boiling Point | 489° F. |
| 95% Point | 905° F. |
| Conradson Carbon | 9.96 |

| FCC Clarified Slurry Oil | |
|---|---|
| Sulfur | 1.04% |
| Nitrogen | 4400 ppm |
| Pour Point | 50° F. |
| Initial Boiling Point | 470° F. |
| 95% Point | 924° F. |
| Conradson Carbon | 10.15 |

| Heavy Cycle Oil | |
|---|---|
| Sulfur | 1.12% |
| Nitrogen | 420 ppm |
| Initial Boiling Point | 373° F. |
| 95% Point | 752° F. |
| Conradson Carbon | 10.15 |

An FCC main column bottoms refinery fraction is a highly preferred solvent for the practice of the present invention process. A typical FCC main column bottoms (or FCC clarified slurry oil) contains a mixture of chemical constituents as represented in the following mass spectrometric analysis:

| Compounds | Aromatics | Naphthenic/ Aromatics | Labile $H_2$ % |
|---|---|---|---|
| Alkyl-Benzene | 0.4 | | 0 |
| Naphthene-Benzenes | | 1.0 | 0.03 |
| Dinaphthene-Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene-phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 5.4 | | |
| Naphthobenzothiophenes | | 2.4 | 0.04 |
| Total | 64.4 | 35.6 | 0.60 |

A typical FCC main column bottoms has the following nominal analysis and properties:

| Elemental Analysis, Wt.%: | |
|---|---|
| C | 89.93 |
| H | 7.35 |
| O | 0.99 |
| N | 0.44 |
| S | 1.09 |
| Total | 99.80 |
| Pour Point, °F.: 50 | |
| CCR, %: 9.96 | |
| Distillation: | |
| IBP, °F.: 490 | |
| 5%, °F.: 800 (est.) | |
| 95%, °F.: 905 | |

FCC main tower bottoms are obtained by the catalytic cracking of gas oil in the presence of a solid porous catalyst. A more complete description of the production of this petroleum fraction is disclosed in U.S. Pat. No. 3,725,240.

FCC main column bottoms is an excellent liquefaction solvent medium for coal and/or wood solubilization because it has a unique combination of physical properties and chemical constituency. A critical aspect of solvating ability is the particular proportions of aromatic and naphthenic and paraffinic moieties characteristic of a prospective liquefaction solvent. A high content of aromatic and naphthenic structures as well as high phenol content in a solvent is a criterion for high solvating ability for carbonaceous material liquefaction.

By thermally-stable aromatic coal-derived solvents is meant the liquid products obtained by processing coal, as by liquefaction and destructive distillation procedures, such products being rich in aromatics and generally boiling above 500° F. These solvents include, for example, the coal tar fraction boiling above 500° F. and known as anthracene oil which is useful as solvent in the present process. Also of use as solvent for this process are aromatic coal liquids obtained by solvent refining of coal. The thermally-stable liquid product of such refining, referred to as SRC, is rich in aromatics, usually boiling above 650° F., and is soluble in pyridine.

The alkaline compound includes a variety of alkaline inorganic compounds which are preferably alkali or alkaline earth metal compounds, including sodium, potassium, calcium, barium and lithium oxides, hydroxides, carbonates and phosphates. Exemplary compounds include sodium hydroxide, potassium hydroxide, sodium carbonate, sodium bicarbonate, potassium carbonate, potassium bicarbonate, lithium carbonate, trisodium phosphate, calcium oxide, potassium oxide and the like and mixtures thereof. In addition, naturally-occurring minerals containing such salts can be employed, e.g., trona ($NaHCO_3/Na_2CO_3/NaOH$). For the purpose of this disclosure, the alkali compound includes any alkali or alkaline earth metal compound which on dissociation or hydrolysis in water at a 1 molar concentration gives a pH of at least about 8 and preferably at least about 11.

The amount of alkaline compound employed can vary considerably from as little as only trace amounts up to significant quantities in comparison with the charged carbonaceous materials and the solvent system employed. While the exact role of the alkaline compound is not fully understood, it would appear to perform a catalytic function since only small quantities of the compound are effective and the compound appears to remain unchanged in the reaction mixture after completion. Thus, as little as 0.1% by weight based on the weight of the solid carbonaceous material is effective but for best results at least about 1% by weight should be used, preferably from about 5% to about 10% by weight of the solid carbonaceous materials. The use of larger than 10% by weight, while still effective, is not warranted since no substantial improvement is realized.

Hydrogen donor for the purpose of the present invention is intended to include organic compounds which are capable of providing hydrogen to another molecular at high temperatures, usually by conversion of the donor compound from a hydroaromatic compound to a fully aromatic compound with the release of hydrogen. Hydrogen donors are well-known in the petroleum arts, e.g., as in Hydrogen-Donor-Diluent-Visbreaking (HDDV). For most purposes, hydrogen donors are condensed aromatic ring compounds which are partially or even completely hydrogenated such as hydrogenated naphthalenes, e.g., tetrahydronaphthalene and decahydronaphthelene. Partially hydrogenated refinery streams containing high concentration of condensed aromatic ring compounds can also serve as the hydrogen donor. Hydrogen donors are also known as thermal hydrogen transfer agents. For the purposes of the present disclosure and the appended claims, the term "hydrogen donor" is meant to be synonymous with thermal hydrogen transfer agent and embraces the aforementioned compounds and classes of compounds.

For the purpose of the present invention, the aromatic petroleum solvent can be hydrogenated to produce partially hydrogenated condensed ring aromatic hydrocarbons which can function as the hydrogen donor.

Regeneration of the hydrogen donor for a continuous process can be brought about by the mere expedient of separation of the dehydrogenated donor, e.g., by fractionation, followed by hydrogenation.

The amount of hydrogen donor employed in the present process can vary over wide ranges with greater improvement being realized at the higher levels. Thus, as little as 0.5% by weight based on the solvent will result in improvement in the effective hydrogen index. For most purposes, the level of hydrogen donor can be maintained at from about 2% to about 30% by weight of solvent to obtain appreciable results. The level of hydrogen donor in the reaction system can be readily monitored as the reaction proceeds which is especially desirable for continuous cycle processing.

The starting carbonaceous materials are preferably employed in comminuted form which is convenient for dissolution in the reaction medium. For example, wood is preferably in the form of sawdust while coal is used in powdered form. The term "wood" means fibrous plant material consisting essentially of cellulose and lignin, e.g., Pin Oak, White Oak, Pine and Fir wood. Varieties of coal can be used and include High Volatile A Bituminous, Sub Bituminous and Lignite. Various peats, as well as peat products such as peat coal and coke, are suitable for use in the present process.

The process of this invention is accomplished by forming a slurry of the starting carbonaceous material in the solvent system and heating the slurry in the presence of the hydrogen donor and alkaline compound. The latter components can be added separately or simultaneously to the slurry either before or after heating is initiated. It is preferred that the full charge of hydrogen donor and alkali be presented in the slurry for the full term of heating in the reactive temperature range although it is possible to meter in each of these components during the heating step.

The process is conveniently carried out at atmospheric pressure in an open reactor or preferably at elevated pressure. The heating step is conducted for time periods ranging from as little as 10 seconds to about 5 hours, preferably from about 0.5 to about 4 hours at preferred reaction temperatures. The slurry can be conveniently pumped through a tubular reactor and heated to elevated temperatures, e.g., 600°-900° F., with a residence time of from as little as 10 seconds up to about 5 hours. The time of reaction can be conveniently monitored by measurement of the carbon oxides, i.e., carbon dioxide and carbon monoxide, which evolve. Thus, the reaction can be controlled to any desired degree as measured by the evolved carbon oxides. Of course, when oxides of carbon are no longer generated, the reaction is essentially complete.

The temperature of the present process can vary within wide ranges but generally is within from about 350° F. and about 1000° F., with the preferred range being from about 500° to about 800° F.

The slurry employed in this process is provided by mixing one part of carbonaceous material with from 0.5 to 10 parts by weight of the petroleum solvent with from about 1 to about 5 parts being preferred.

After the reaction is terminated, the product can be separated into solid, i.e., ash and/or unreacted feed, and liquid components. The liquid component can be fractionated, e.g., to heavy liquid product, light product and solvent for recycle.

Alternatively, the reaction mixture can be used as liquid fuel such as in heavy oil-fired stationary power generators. If the reaction mixture is deashed, e.g., by filtration, the product can be used as a more valuable fuel oil. The reaction product can also be further treated by the addition of cutting stocks, including kerosene and light gas oil fractions.

In comparison with the process of U.S. Pat. No. 4,052,292, the present process results in an increase in carbon dioxide release and a dramatic reduction in water formation. Thus, the presence of the hydrogen donor and alkaline compound results in greater oxygen rejection via carbon oxides and suppresses water formation to yield premium liquid products of higher hydrogen contents. These unexpected results are shown in the following examples which are further illustrative of the invention.

EXAMPLE 1

A one liter autoclave outfitted with a Grove loader on the exit line was charged with sawdust, aromatic solvent (main column bottoms), tetralin and sodium carbonate and the autoclave was heated to 375°-380° C. over 3-4 hours after which it was held at temperature for one hour.

The autoclave (originally 1 atm He) increased as heating proceeded eventually equaling the 1000 psi Grove loader pressure used in all experiments. Products exiting the autoclave passed first through a dry ice trap en route to a gas collection buret. At the end of the run, the autoclave was rapidly quenched and the pressure dropped to atmospheric through the cold trap and on to the buret.

Carbon monoxide and dioxide from wood decomposition were determined by mass spectrography and/or gas chromatographic analyses of the collected gases. The water formed was determined by separating and weighing the water layer in the cold trap liquid and adding to that the water contained in the autoclave liquid product.

Wood conversion was determsined by pyridine extraction and subsequent ashing of the insoluble residue (if any), using the procedure described in U.S. Pat. No. 4,052,292.

Total material balances were 95% or higher. The results are given in the following Table in which the results were calculated on a no-loss basis.

TABLE

| | |
|---|---|
| Heating Time to Reach Temperature | : ~3.5 hours |
| Time at Reaction Temperature | : 1 hour |
| Reaction Temperature | : 375-380° C. |
| Reaction Pressure | : 1000 psig |
| Gms FCC Bottoms Solvent Oil | : 300-320 |
| Gms Sawdust (Dry) | : 92-103 |
| Gms $Na_2CO_3$ (except where noted) | : 8-8.7 |

| | Run # | | | | |
|---|---|---|---|---|---|
| | 1 | 2 | 3 | 4 | 5 |
| Tetralin Used- (wt % Wood + FCC Bottoms) | 0 | 2 | 5 | 10 | 30 |
| Net $H_2O$ Rejected (wt % Dry Wood) | 21.6 | 17.4 | 14.8 | 8.1 | 1.2 |
| $CO_2$ Rejected | 15.3 | 20.9 | 21.6 | 21.8 | 22.3 |

TABLE-continued

| | | | | | |
|---|---|---|---|---|---|
| (wt % Dry Wood) | | | | | |
| Total $CO_x$ Rejected (wt % Dry Wood) | 17.4 | 22.7 | 23.2 | 23.9 | 24.7 |
| Wt % Dry Wood To Liquid Product | 60.3 | 60.0 | 61.9 | 67.9 | 74.1 |
| % Wood in TLP which is pyridine soluble | 84.4 | 85.0 | 81.0 | 88.0 | 97.4 |
| Effective Hydrogen Index of Wood in TLP | 0.80 | 0.96 | 0.99 | 1.01 | 1.03 |
| Total Dry Wood Conversion to pyridine Solubles $+H_2O$ $+CO_x$ (wt %) | 93.0 | 91.1 | 89 | 91.5 | 98.1 |
| Total Material Balance for Run-All Components wt % | 95.0 | 96.3 | 97.3 | 97.1 | 98.2 |

Notes:
No $Na_2CO_3$ employed in Run 1
TLP = Total liquid product

The sawdust employed had the following elemental analysis (%, moisture-free): C, 47.94; H, 6.6; O, 42.28; ash, 0.59; and the FCC Bottoms: C, 90.46; H, 6.69; 0, 1.02; N, 0.37; S, 1.6. The wood had an effective Hydrogen Index of 0.33 and approximate molecular formula, $C_6H_{10}O_4$.

Discussion of Results:

In theory, the sawdust could be converted to hydrocarbons in a 40% weight yield simply by rejection of combined oxygen as carbon dioxide:

$$(C_6H_{10}O_4)_x \rightarrow 4(CH_{2.5})_x + 2x\ CO_2$$

The hypothetical hydrocarbon product has an H/C atomic ratio of 2.5 and contains 17.2% hydrogen.

The results of Run 1 which is conducted in the absence of hydrogen donor and sodium carbonate (in accordance with U.S. Pat. No. 4,052,292) gives an overall material balance as follows:

$$C_6H_{10}O_4 \rightarrow 5.4(CH_{1.2}O_{0.2}) + 0.5CO_2 + 0.1CO + 1.75\text{-}H_2O$$

While more than 70% of the oxygen was rejected during heating, 60% of the oxygen was rejected as water.

The results of Runs 2-5, however, show promoted oxygen rejection via $CO_2$ and suppression of water formation. As is obvious from the tabular data, the effect of the tetralin concentration on water formation is quite dramatic. In Run 5, water formation was reduced to 1.2% of the dry wood. The material balance, neglecting the role of hydrogen enrichment by tetralin, can be expressed as follows:

$$C_6H_{10}O_4 \rightarrow 5.2CH_{1.9}O_{0.44} + 0.75CO_2 + 0.1CO + 0.1H_2O$$

About 42% of the combined oxygen in the sawdust was rejected and over 94% of the rejected oxygen was in the form of carbon oxides, resulting in a near theoretical effective hydrogen index for this conversion level.

The liquid product, although it contains a substantial concentration of combined oxygen is almost completely soluble in pyridine. Due to the improved effective hydrogen index, this product is suitable to be further processed to obtain premium hydrocarbon or petrochemical products via conventional hydroprocessing technology.

The effective hydrogen index values for Runs 2-5 show approximately a 25% increase over that of Run 1.

EXAMPLE 2

The procedure of Example 1 is repeated using Wyodak subbituminous coal in lieu of wood with comparable results.

Maxium selectivity for carbon dioxide occurred when the solvent contained tetralin (as hydrogen transfer agent) at a level of 4-5%.

What is claimed is:

1. A process for the conversion of solid carbonaceous material to a hydrocarbon-rich product which comprises:

(a) slurrying said material in a thermally stable aromatic petroleum or coal-derived solvent, and (b) heating said slurry at elevated temperature in the presence of a hydrogen donor and alkali and in the absence of added carbon monoxide and added water to evolve carbon oxides therefrom.

2. The process according to claim 1 wherein said solvent is a thermally stable petroleum refinery FCC main column bottoms or TCC syntower bottoms having a boiling point between about 450° and 1100° F.

3. The process according to claim 1 wherein said solvent is a solvent-refined coal product having a boiling point above about 650° F.

4. The process according to claim 1 wherein said hydrogen donor comprises tetrahydronaphthalene.

5. The process according to claim 1 wherein said alkali comprises alkali or alkaline earth metal carbonates.

6. The process according to claim 1 wherein the alkali comprises sodium carbonate.

7. The process according to claim 1 wherein the temperature is in the range of from about 350° to about 1000° F.

* * * * *

UNITED STATES PATENT AND TRADEMARK OFFICE

CERTIFICATE OF CORRECTION

PATENT NO. : 4,247,384

DATED : January 27, 1981

INVENTOR(S) : Mai Yuen Chen et al

It is certified that error appears in the above-identified patent and that said Letters Patent are hereby corrected as shown below:

Column 4, lines 53-54, "molecular" should be -- molecule --

Column 4, line 64, "containing high" should be -- containing a high --

Column 5, line 43, "presented" should be -- present --

Column 6, line 48, "determsined" should be -- determined --

Signed and Sealed this

*Fifth* Day of *May 1981*

[SEAL]

*Attest:*

RENE D. TEGTMEYER

*Attesting Officer* *Acting Commissioner of Patents and Trademarks*